US010036524B2

(12) United States Patent
Tezuka et al.

(10) Patent No.: US 10,036,524 B2
(45) Date of Patent: Jul. 31, 2018

(54) VEHICLE LAMP

(71) Applicant: NITTO DENKO CORPORATION, Ibaraki-shi, Osaka (JP)

(72) Inventors: Teppei Tezuka, Osaka (JP); Youzou Yano, Osaka (JP); Kouji Furuuchi, Osaka (JP)

(73) Assignee: NITTO DENKO CORPORATION, Osaka (JP)

( * ) Notice: Subject to any disclaimer, the term of this patent is extended or adjusted under 35 U.S.C. 154(b) by 0 days.

(21) Appl. No.: 15/128,341

(22) PCT Filed: Feb. 25, 2015

(86) PCT No.: PCT/JP2015/000967
§ 371 (c)(1),
(2) Date: Sep. 22, 2016

(87) PCT Pub. No.: WO2015/145970
PCT Pub. Date: Oct. 1, 2015

(65) Prior Publication Data

US 2017/0122521 A1 May 4, 2017

(30) Foreign Application Priority Data

Mar. 24, 2014 (JP) ..... 2014-059866

(51) Int. Cl.
*F21V 1/00* (2006.01)
*F21S 45/30* (2018.01)
*F21S 8/10* (2006.01)

(52) U.S. Cl.
CPC ..... *F21S 45/30* (2018.01); *F21S 48/332* (2013.01)

(58) Field of Classification Search
CPC ..... F21S 48/335
USPC ..... 362/547, 294, 345, 218, 509
See application file for complete search history.

(56) References Cited

U.S. PATENT DOCUMENTS

| | | | | |
|---|---|---|---|---|
| 4,833,572 A * | 5/1989 | Nagengast | ..... | F21S 48/335 362/294 |
| 6,364,924 B1 | 4/2002 | Mashiko et al. | | |
| 6,497,507 B1 | 12/2002 | Weber | | |
| 6,994,621 B2 | 2/2006 | Mashiko et al. | | |
| 8,821,226 B2 | 9/2014 | Yano et al. | | |
| 8,828,125 B2 | 9/2014 | Furunchi et al. | | |

FOREIGN PATENT DOCUMENTS

| | | |
|---|---|---|
| CN | 1295659 A | 5/2001 |
| JP | 2-121201 | 5/1990 |
| JP | 7-147106 | 6/1995 |
| JP | 2001-143524 | 5/2001 |
| JP | 2001-332117 | 11/2001 |

(Continued)

*Primary Examiner* — Jamara Franklin
(74) *Attorney, Agent, or Firm* — Hamre, Schumann, Mueller & Larson, P.C.

(57) ABSTRACT

A vehicle lamp (100) includes a light source (10), a lens (20), a housing (30), and a vent portion (40). The housing (30) is combined with the lens (20) to form a lamp space (50) in which the light source (10) is disposed. The lamp space (50) includes a narrow gap region (50*a*) having a width of 10 mm or less between the lens (20) and the housing (30). This width corresponds to the distance between them. The vent portion (40) is provided on the housing (30) at a position facing the narrow gap region (50*a*).

8 Claims, 5 Drawing Sheets

(56) References Cited

FOREIGN PATENT DOCUMENTS

| | | |
|---|---|---|
| JP | 2004-047425 | 2/2004 |
| JP | 2006-324260 | 11/2006 |
| JP | 2007-141629 | 6/2007 |
| JP | 2011-165488 | 8/2011 |
| JP | 2011-233518 | 11/2011 |
| JP | 2013182882 | 9/2013 |
| WO | 98/31966 | 7/1998 |

* cited by examiner

VEHICLE LAMP

TECHNICAL FIELD

The present invention relates to vehicle lamps.

BACKGROUND ART

Vehicle lamps such as a head lamp and a tail lamp has a lamp space formed by a lens and a housing. A light source such as an LED light bulb is disposed in the lamp space. In the lamp space, condensation may occur and cause fogging of the lens. This is one of the problems of vehicle lamps. In order to prevent condensation, it is effective to form a completely enclosed lamp space. However, since plastic materials that form the lens and the housing are hygroscopic, it is essentially impossible to form a completely enclosed lamp space. In addition, once a completely enclosed lamp space is formed, moisture penetrating into the lamp space cannot be allowed to escape to the outside. In view of this, conventional vehicle lamps are provided with a vent member to prevent fogging of a lens (see Patent Literatures 1 and 2). The vent member prevents entry of foreign substances such as rainwater and dust into the lamp space and allows movement of gases such as water vapor between the lamp space and the outside space. The vent member also prevents the pressure in the lamp space from increasing with temperature changes.

CITATION LIST

Patent Literature

Patent Literature 1: JP 07(1995)-147106 A
Patent Literature 2: JP 2006-324260 A

SUMMARY OF INVENTION

Technical Problem

New vehicle lamps, for example, combination lamps, have a very complex structure. In a vehicle lamp having a complex structure, the fogging preventing effect of the vent member may not be sufficiently obtained. Even if the vehicle lamp has a simple structure, the fogging preventing effect of the vent member may not be sufficiently obtained.

It is an object of the present invention to provide a technique for preventing fogging of a lens in a vehicle lamp.

Solution to Problem

The present inventors have examined in detail where in a vehicle lamp it is difficult to prevent fogging from occurring and it is difficult to eliminate fogging once it has occurred. As a result, they have found out that it is difficult to prevent fogging from occurring in a narrow space between a lens and a housing (narrow gap region) or it is difficult to eliminate fogging that has occurred in such a narrow space.

That is, the present disclosure provides a vehicle lamp including:

a light source;

a lens disposed in front of the light source;

a housing combined with the lens to form a lamp space in which the light source is disposed; and a vent portion provided on the housing to allow ventilation of the lamp space, wherein the lamp space includes a narrow gap region having a width of 10 mm or less between the lens and the housing, the width corresponding to a distance therebetween, and the vent portion is provided on the housing at a position facing the narrow gap region.

Advantageous Effects of Invention

In the vehicle lamp as described above, the vent portion is provided on the housing at a position facing the narrow gap region. Therefore, the fogging preventing effect of the vent portion is exerted directly on the narrow gap region. Thus, it is possible not only to prevent fogging of the lens from occurring in the narrow gap region but also to eliminate fogging of the lens rapidly after the occurrence of the fogging in the narrow gap region. As a result, it is possible to prevent fogging of the lens entirely and effectively.

DESCRIPTION OF EMBODIMENTS

Hereinafter, embodiments of the present invention will be described with reference to the drawings. The present invention is not limited to the following embodiments.

(First Embodiment)

Figure 1:
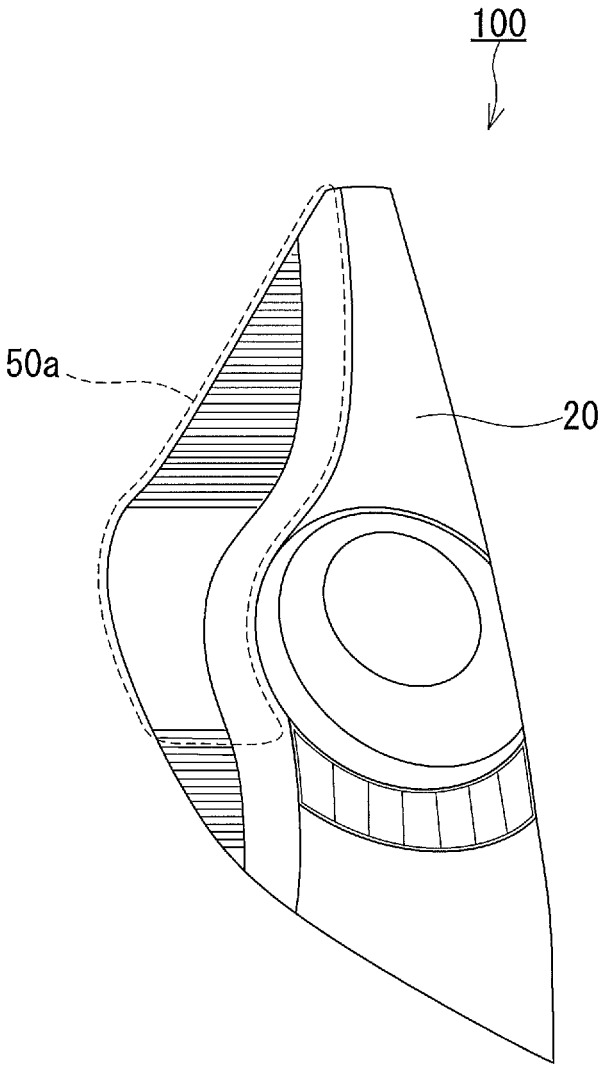
FIG. 1 is a front-side perspective view of a vehicle lamp according to a first embodiment of the present invention.
Figure 2:
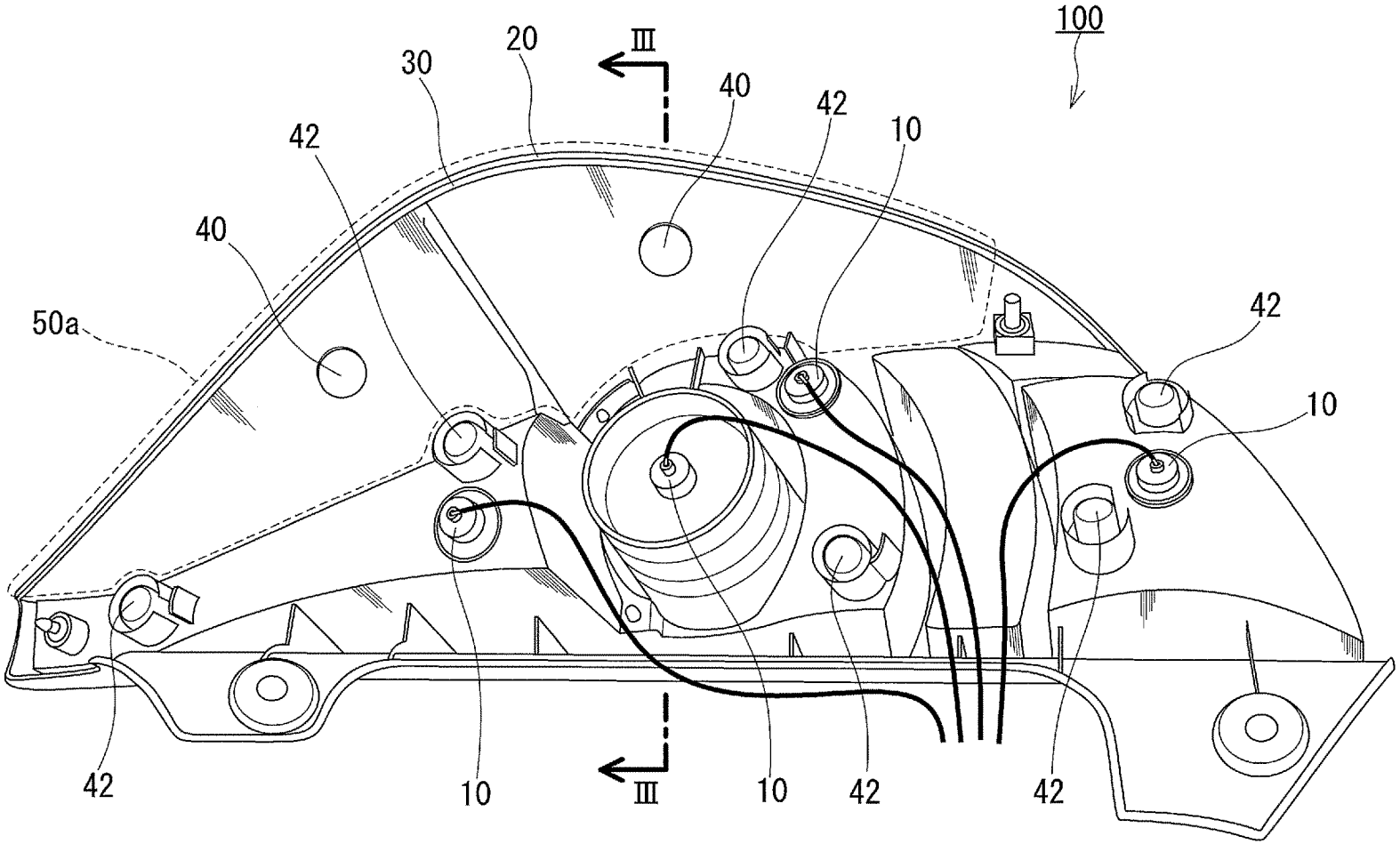
FIG. 2 is a rear-side perspective view of the vehicle lamp shown in FIG. 1.
Figure 3:
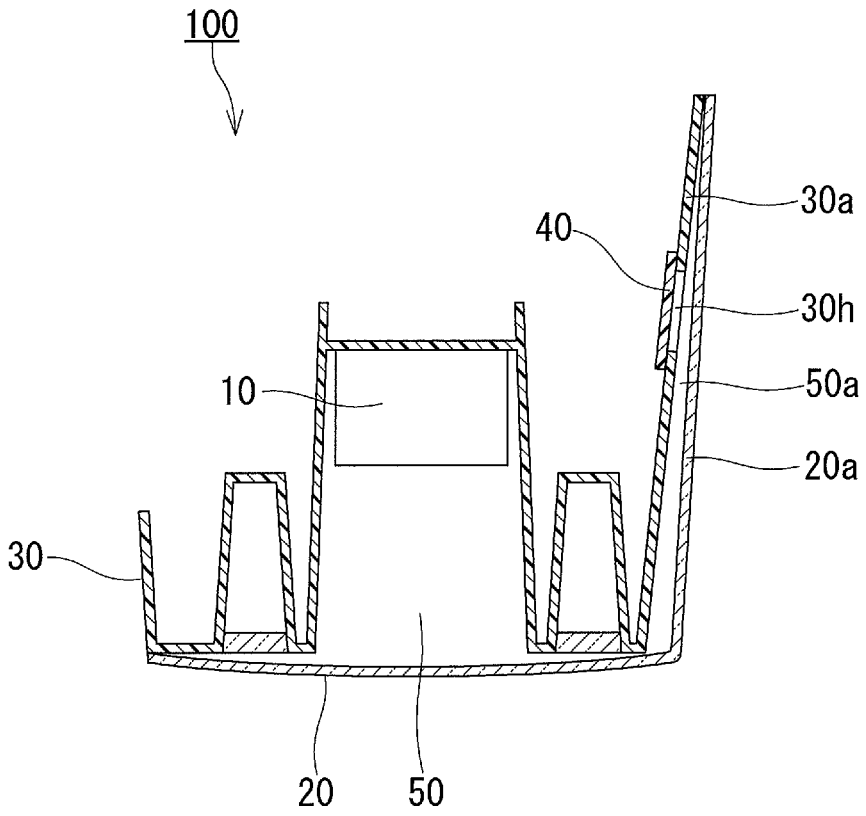
FIG. 3 is a schematic cross-sectional view of the vehicle lamp shown in FIG. 1 and FIG. 2, taken along the line III-III.

As shown in FIG. 1 to FIG. 3, a vehicle lamp 100 according to the present embodiment includes a plurality of light sources 10, a lens 20, and a housing 30. The lens 20 is disposed in front of the light sources 10. The lens 10 and the housing 30, in combination with each other, form a lamp space 50. The light sources 10 are disposed in the lamp space 50. In the present embodiment, the vehicle lamp 100 is a tail lamp, and more specifically, a combination lamp including a tail lamp, a stop lamp, and a turn signal lamp.

The light sources 10 are LED light bulbs, for example. The light sources 10 are selected as appropriate according to the intended use of the vehicle lamp 100. The lens 20 is a member made of a resin having visible light transmitting properties, for example, an acrylic resin. The housing 30 is a member made of a thermoplastic resin such as polypropylene (PP), polybutylene terephthalate (PBT), acrylate-styrene-acrylonitrile (ASA) copolymer, acrylonitrile-butadiene-styrene (ABS) copolymer, polycarbonate (PC), PC/ABS alloy, or the like. The outer surface of the housing 30 is plated by sputtering, for example, to reflect light or improve the aesthetic appearance. The lens 20 and the housing 30 can each be produced by injection molding. Other members such as a reflector may be disposed in the lamp space 50.

As shown in FIG. 2, a plurality of vent portions 40 and 42 are provided on the housing 30. More specifically, a plurality of first vent portions 40 and a plurality of second vent portions 42 are provided on the housing 30. However, the number of the first vent portions 40 is not limited, and only one first vent portion 40 may be provided on the housing 30.

The first vent portions 40 are each an air-permeable membrane including a porous resin membrane, for example. Examples of the material for the porous resin membrane include a fluororesin porous body and a polyolefin porous body. Examples of the fluororesin include polytetrafluoroethylene, polychlorotrifluoroethylene, tetrafluoroethylene-hexafluoropropylene copolymer, and tetrafluoroethylene-ethylene copolymer. Examples of monomers in the polyolefin include ethylene, propylene, and 4-methylpentene-1,1-butene. A polyolefin obtained by polymerizing these monomers alone or copolymerizing these monomers can be used. The air-permeable membrane may include not only the porous resin membrane but also a reinforcing layer laminated thereon. The reinforcing layer is, for example, a nonwoven fabric made of a resin such as polyethylene.

In the present embodiment, the air-permeable membrane as the first vent portion 40 is attached to the housing 30 so as to cover a vent hole 30*h* formed in the housing 30. Specifically, the air-permeable membrane is welded to the housing 30 by a welding technique such as heat welding, ultrasonic welding, or the like. The air-permeable membrane may be attached to the housing 30 using an adhesive or a double-sided adhesive tape. In such a configuration, the first vent portion 40 protrudes only slightly from the inner surface of the housing 30, and thus the volume of the space occupied by the first vent portion 40 is small.

The first vent portion 40 may be a cap-seal type vent member (see JP 2001-143524 A), a snap-fit type vent member (see JP 2007-141629 A), or a screw type vent member (see JP 2004-47425 A). That is, the type of the vent member that can be used as the first vent portion 40 is not particularly limited. However, the present embodiment can overcome the problem of the occupied space, as described above.

As shown in FIG. 2 and FIG. 3, the lamp space 50 includes a narrow gap region 50*a* having a width of 10 mm or less (0.1 to 10 mm) between the lens 20 and the housing 30. The narrow gap region 50*a* is a portion of the lamp space 50 enclosed by a dashed line in FIG. 1 and FIG. 2. As shown in FIG. 2 and FIG. 3, the first vent portions 40 are provided on the housing 30 at positions facing the narrow gap region 50*a*. According to the present embodiment, the fogging preventing effect of the first vent portions 40 is exerted directly on the narrow gap region 50*a*. Therefore, it is possible not only to prevent fogging of the lens 20 from occurring in the narrow gap region 50*a* but also to eliminate fogging of the lens 20 rapidly after the occurrence of the fogging in the narrow gap region 50*a*. As a result, it is possible to prevent fogging of the lens 20 entirely and effectively.

As shown in FIG. 3, the lens 20 has a side wall portion 20*a* and the housing 30 has a side wall portion 30*a*, and these side wall portions 20*a* and 30*a* are both located lateral to the light source 10. The side wall portion 20*a* of the lens 20 and the side wall portion 30*a* of the housing 30 are each a portion extending forward and backward at a side of the light source 10. The phrase "extending forward and backward" means extending in the front direction and the rear direction of the light source 10. These side wall portions 20*a* and 30*a* are provided to fit the vehicle lamp 100 to the shape of the corner portion of the vehicle, for example. In the lamp space 50, the narrow gap region 50*a* is included in a region defined by the side wall portion 20*a* of the lens 20 and the side wall portion 30*a* of the housing 30. Once fogging occurs in this narrow gap region 50*a*, it is difficult for the second vent portions 42 alone to eliminate the fogging. Therefore, the presence of the first vent portions 40 provided in this narrow gap region 50*a* can maximize its benefits.

As shown in FIG. 2 and FIG. 3, the side wall portion 30*a* of the housing 30 has a curved surface shape. The first vent portion 40 has a curved surface shape conforming to the shape of the side wall portion 30*a* of the housing 30. That is, the vent surface (surface responsible for ventilation) of the first vent portion 40 is a curved surface. With such a configuration, the height of the first vent portion 40 protruding from the side wall portion 30*a* of the housing 30 can be minimized. The side wall portion 30*a* of the housing 30 may have a flat surface shape, of course. In this case, it is desirable that the first vent portion 40 also have a flat surface shape.

As shown in FIG. 2, the second vent portions 42 are each a so-called cap-seal type vent member. Cap-seal type vent members are well known to those skilled in the art, as described in JP 2001-143524 A, for example. Like the first vent portions 40, the second vent portions 42 are also attached to the housing 30 so as to cover vent holes formed in the housing 30. The second vent portions 42 are all provided on the housing 30 at positions facing a region other than the narrow gap region 50*a* in the lamp space 50.

In the present embodiment, a vent member as the second vent portion 42 is composed of a cover, a tubular body, and an air-permeable membrane. The cover is a tubular member having a bottom portion. The tubular body is made of an elastomer. The air-permeable membrane is attached to the tubular body so as to cover one of the openings of the tubular body. The tubular body is fitted into the cover so as to allow the cover to protect the air-permeable membrane. An air passage is formed between the inner peripheral surface of the cover and the outer peripheral surface of the tubular body, and an air passage is also formed between the bottom surface of the cover and the top surface of the air-permeable membrane. The vent member thus configured is attached to a nozzle portion of the housing 30. The nozzle portion is a portion having a vent hole. However, the type of the vent member that can be used as the second vent portion 42 is not particularly limited.

The second vent portion 42 is not an essential element, and only the first vent portion 40 may be provided on the housing 30. However, when not only the first vent portion 40 but also the second vent portion 42 is provided on the housing 30, fogging of the lens 20 can be prevented or eliminated more effectively. The number of the second vent portions 40 also is not limited, and only one second vent portion 42 may be provided on the housing 30.

(Second Embodiment)

Figure 4:
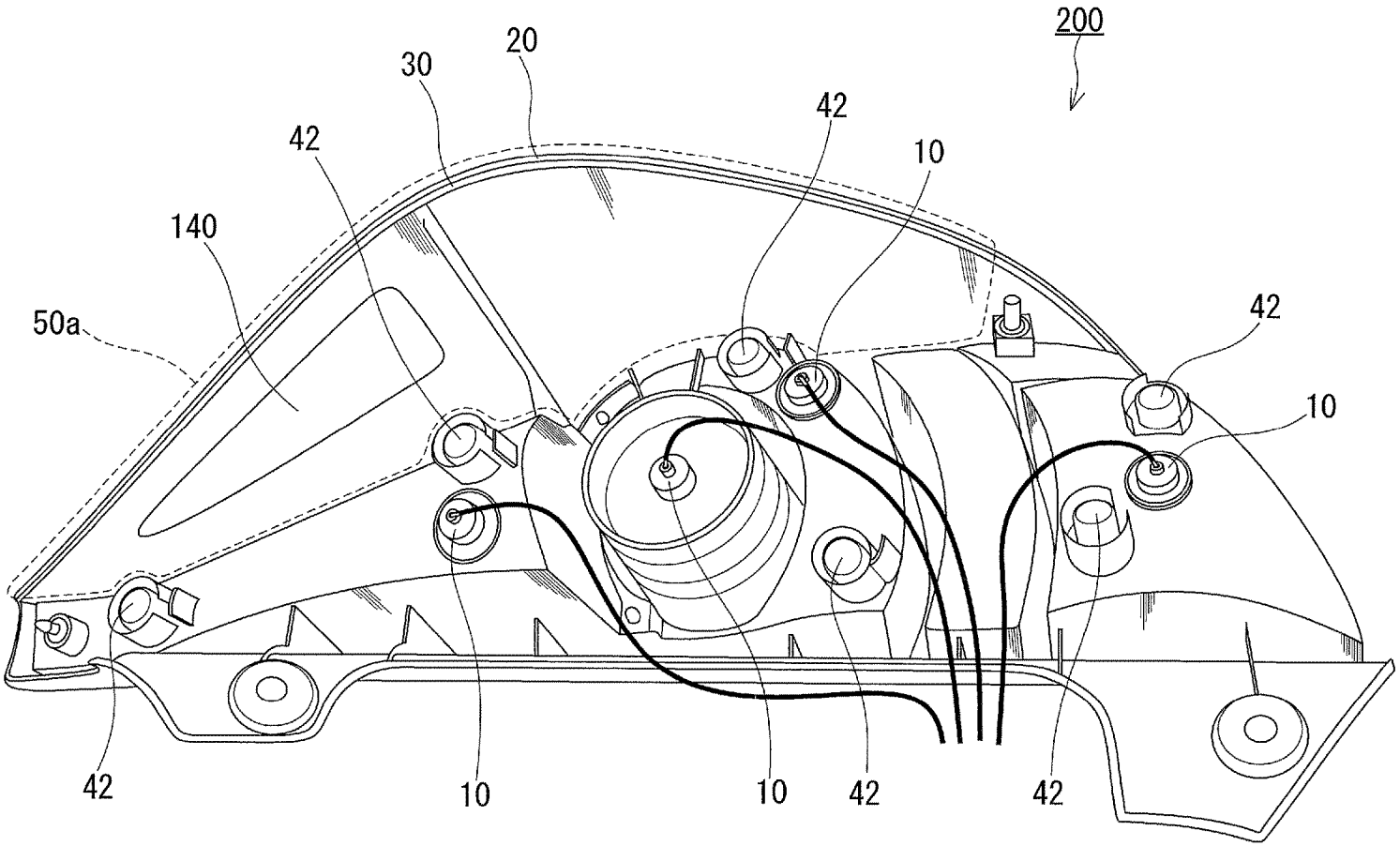
FIG. 4 is a rear-side perspective view of a vehicle lamp according to a second embodiment of the present invention.

As shown in FIG. 4, a vehicle lamp 200 according to the present embodiment includes a first vent portion 140 and a plurality of second vent portions 42. The structure of the vehicle lamp 200, except for the first vent portion 140, is the same as that of the vehicle lamp 100 of the first embodiment. Therefore, the elements of the vehicle lamp 200 of the present embodiment corresponding to those of the vehicle lamp 100 of the first embodiment are denoted by the same reference numerals, and the description thereof may be omitted. That is, the descriptions of these embodiments can be applied to each other as long as no technical contradiction arises. Furthermore, these embodiments may be combined with each other as long as no technical contradiction arises.

As described in the first embodiment, the housing 30 can be a member made of a thermoplastic resin such as polypropylene. The first vent portion 140 is formed of a thermoplastic resin porous body and is integrated with the housing 30 to serve as a part that defines the narrow gap region 50*a*. In other words, the first vent portion 140 forms a part of the housing 30.

In the present embodiment, the first vent portion 140 is formed of a porous body having appropriate stiffness. Such a porous body is, for example, an ultra-high molecular weight polyethylene porous body. An ultra-high molecular weight polyethylene porous body having a desired shape can be obtained by cutting a sintered body of ultra-high molecular weight polyethylene powder. That is, it is relatively easy to form an ultra-high molecular weight polyethylene porous body into a desired shape (three-dimensional shape) or into a thickness large enough. Therefore, such an ultra-high molecular weight polyethylene porous body is a material suitable for use as the first vent portion 140. As used herein, the term "ultra-high molecular weight polyethylene" refers to a polyethylene having an average molecular weight of 500,000 or more (or 1,000,000 or more). The average molecular weight of ultra-high molecular weight polyethylene is typically in the range of 2,000,000 to 10,000,000. The average molecular weight can be measured, for example, by a method according to ASTM D 4020 (viscosity test).

Alternatively, the first vent portion 140 may be a porous body obtained through a pelletization step, an injection molding step, and an extraction step described below. The pelletization step is a step of dissolving and mixing, at 200° C. to 235° C., pentaerythritol, polybutylene terephthalate resin, and one selected from polyfunctional alcohol which is liquid at ordinary temperature, polyethylene glycol, and polypropylene glycol, so as to obtain a mixture and extruding the mixture into pellets. The injection molding step is a step of performing injection molding using the pellets obtained in the pelletization step so as to obtain a molded article. The extraction step is a step of immersing the molded article obtained in the injection molding step in water or hot water so as to extract water-soluble components. The porous body obtained by this method has appropriate stiffness and thus can also be used as a structural material. In addition, the porous body obtained by this method is obtained by injection molding and thus can be formed into any desired shape very flexibly.

The method for integrating the first vent portion 140 with the housing 30 is not particularly limited. For example, a porous body as the first vent portion 140 can be integrated with a resin forming the housing 30 by a molding method such as insert molding, in-mold molding, two-color molding, or the like. The porous body as the first vent portion 140 is obtained by cutting or a molding method such as injection molding, as described above. As described in the first embodiment, the porous body as the first vent portion 140 may be welded to the housing 30, or attached to the housing 30 using an adhesive or a double-sided adhesive tape.

As described with reference to FIG. 3, the housing 30 has a side wall portion 30*a* located lateral to the light source 10. The side wall portion 30*a* of the housing 30 has a curved surface shape. Therefore, the first vent portion 140 also has a curved surface shape conforming to the shape of the side wall portion 30*a* of the housing 30. With such a configuration, the height of the first vent portion 140 protruding from the side wall portion 30*a* of the housing 30 can be minimized. In some cases, at least one principal surface (i.e., the outer surface and/or the inner surface) of the housing 30 and at least one principal surface (i.e., the outer surface and/or the inner surface) of the first vent portion 140 may be smoothly connected. The first vent portion 140 may have the same thickness as that of the side wall portion 30*a* of the housing 30.

The structure and position of the second vent portion 42 are as described in the first embodiment. As in the first embodiment, the second vent portion 42 is not an essential element.

EXAMPLES

Example

Figure 5:
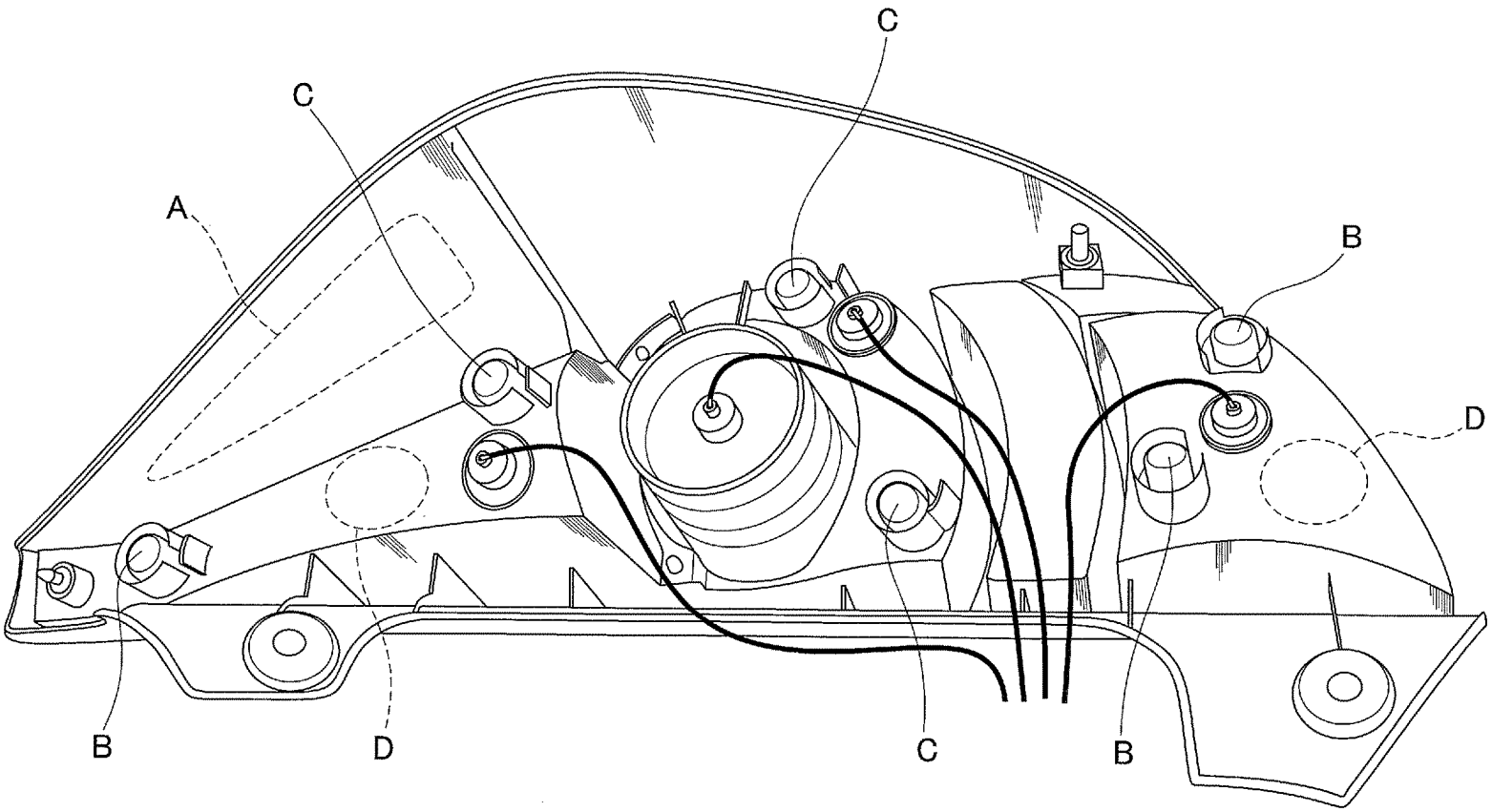
FIG. 5 is a diagram showing the positions of vent portions in vehicle lamps of Example and Comparative Examples.

At the position A shown in FIG. 5, an opening portion (with an opening area of 300 $mm^2$) was formed in a housing. An ultra-high molecular weight polyethylene porous body ("SUNMAP" (registered trademark) manufactured by Nitto Denko Corporation, with a thickness of 2.0 mm) was fixed to the housing with a double-sided adhesive tape (No. 5000 NS, manufactured by Nitto Denko Corporation) so as to cover the opening portion. The opening portions other than the opening portion at the position A were sealed with a tape. This housing was combined with a lens, and thus a vehicle lamp of Example was obtained.

Comparative Example 1

At three positions B shown in FIG. 5, rubber tubes (with a length of 30 mm) were attached to the housing. That is, cap-seal type vent members to be provided at the positions B were replaced by the rubber tubes. The total opening area of the rubber tubes was 58.9 $mm^2$. The opening portions other than the opening portions at the positions B were sealed with a tape. This housing was combined with a lens, and thus a vehicle lamp of Comparative Example 1 was obtained.

Comparative Example 2

At three positions B and three positions C shown in FIG. 5, rubber tubes (with a length of 30 mm) were attached to the housing. That is, cap-seal type vent members to be provided at the positions B and the positions C were replaced by the rubber tubes. The total opening area of the rubber tubes was 117.8 $mm^2$. The opening portions other than the opening portions at the positions B and the positions C were sealed with a tape. This housing was combined with a lens, and thus a vehicle lamp of Comparative Example 2 was obtained.

Comparative Example 3

At two positions D shown in FIG. 5, opening portions (with a total opening area of 300 $mm^2$) were formed respectively in the housing. An ultra-high molecular weight polyethylene porous body ("SUNMAP" (registered trademark) manufactured by Nitto Denko Corporation, with a thickness of 2.0 mm) was fixed to the housing with a double-sided adhesive tape (No. 5000 NS, manufactured by Nitto Denko Corporation) so as to cover each of the opening portions. The opening portions other than the opening portions at the positions D were sealed with a tape. This housing was combined with a lens, and thus a vehicle lamp of Comparative Example 3 was obtained.

[Fogging Elimination Test]

For the vehicle lamps of Example and Comparative Examples, a fogging elimination test was performed in the following manner. First, all the components such as a bulb were removed from the vehicle lamp, and the lamp was placed in a thermostatic chamber with a 90% RH atmosphere at 40° C. for 2 hours. After the lamp was removed from the thermostatic chamber, the components including the bulb were mounted quickly in the lamp and the lamp space was sealed. Next, all the lights were turned on for 10 minutes and then all the lights were turned off. Next, water at 5° C. was poured over the outer surface of the lens for 30 seconds. Then, all the lights were turned on. After the lights were turned on again, the time required to completely eliminate fogging of the inner surface of the lens was measured. Table 1 shows the results.

TABLE 1

| | Position and type of vent member | Opening area (total) [$mm^2$] | Time required to eliminate fogging [min] |
|---|---|---|---|
| Example | PE porous body at position A | 300 | 5 |
| Com. Example 1 | Rubber tubes at positions B | 58.9 | 80 |
| Com. Example 2 | Rubber tubes at positions B and C | 117.8 | 70 |
| Com. Example 3 | PE porous bodies at positions D | 300 | 40 |

As shown in Table 1, the time required to eliminate fogging was shortest in the vehicle lamp of Example. In contrast, the vehicle lamps of Comparative Examples 1 to 3 required a longer time to eliminate fogging. As can be understood from the results of Comparative Examples 1 to 3, there is a correlation between the opening area and the time required to eliminate fogging. However, as can also be understood from the result of Comparative Example 3, even a lamp having a large opening area requires a long time to eliminate fogging unless a vent portion is provided at a position facing the narrow gap region.

INDUSTRIAL APPLICABILITY

The technique disclosed in this description can be applied to vehicle lamps such as headlamps, fog lamps, cornering lamps, tail lamps, stop lamps, backup lamps, turn signal lamps, and daytime running lamps.

The invention claimed is:

1. A vehicle lamp comprising:

a light source;

a lens disposed in front of the light source;

a housing combined with the lens to form a lamp space in which the light source is disposed; and a vent portion provided on the housing to allow ventilation of the lamp space, wherein the lamp space includes a narrow gap region having a width of 0.1 to 10 mm between the lens and the housing, the width corresponding to a distance therebetween, the vent portion is an air-permeable membrane including a porous resin membrane, and the air-permeable membrane is attached to the housing so as to cover a vent hold that is formed in the housing at a position facing the narrow gap region.

2. The vehicle lamp according to claim 1, wherein the housing is a component made of a thermoplastic resin, and the air-permeable membrane is integrated with the housing to serve as a part that defines the narrow gap region.

3. The vehicle lamp according to claim 1, wherein the lens and the housing each have a side wall portion located lateral to the light source, and in the lamp space, the narrow gap region is included in a region defined by the side wall portion of the lens and the side wall portion of the housing.

4. The vehicle lamp according to claim 1, wherein the housing has a side wall portion located lateral to the light source, the side wall portion of the housing has a curved surface shape, and the air-permeable membrane has a curved surface shape conforming to the shape of the side wall portion of the housing.

5. The vehicle lamp according to claim 1, further comprising, when the vent portion is defined as a first vent portion, a second vent portion provided on the housing at a position facing a region other than the narrow gap region in the lamp space.

6. The vehicle lamp according to claim 1, wherein the air-permeable membrane is an ultra-high molecular weight polyethylene porous body obtained by cutting a sintered body of an ultra-high molecular weight polyethylene powder.

7. The vehicle lamp according to claim 1, wherein the air-permeable membrane is formed of a fluororesin porous body or a polyolefin porous body.

8. The vehicle lamp according to claim 1, wherein a shortest distance between the air-permeable membrane and the lens is in a range of 0.1 to 10 mm.

* * * * *